US005094361A

United States Patent [19]

Dubach

[11] Patent Number: 5,094,361

[45] Date of Patent: Mar. 10, 1992

[54] SINGLE OR MULTI-PIECE CLOSURE FOR RIGID OR DEFORMABLE CONTAINERS

[75] Inventor: Werner F. Dubach, Maur, Switzerland

[73] Assignee: Firma Createchnic AG, Switzerland

[21] Appl. No.: 531,797

[22] Filed: May 31, 1990

[30] Foreign Application Priority Data

Jun. 9, 1989 [CH] Switzerland ..... 02167/89-4

[51] Int. Cl.[5] ..... B67D 3/00

[52] U.S. Cl. ..... 222/81; 222/524; 222/525; 222/541; 222/556; 215/257; 220/277

[58] Field of Search ..... 222/86, 83, 91, 521-525, 222/541, 545, 562; 215/297, 257, 346, 351; 220/277, 278; 206/603

[56] References Cited

U.S. PATENT DOCUMENTS

| | | | |
|---|---|---|---|
| 4,722,449 | 2/1988 | Dubach | 215/235 |
| 4,779,764 | 10/1988 | Debetencourt | 222/91 |
| 4,795,043 | 1/1989 | Odet et al. | 222/83 |
| 4,813,578 | 3/1989 | Gordon et al. | 222/541 |
| 4,869,399 | 9/1989 | Dubach | 222/83 |
| 4,884,705 | 12/1989 | Debetencourt | 222/83 |
| 4,948,015 | 8/1990 | Kawajiri et al. | 222/83 |

FOREIGN PATENT DOCUMENTS

| | | | |
|---|---|---|---|
| 2597438 | 10/1987 | France | 222/525 |

*Primary Examiner*—Michael S. Huppert
*Assistant Examiner*—Philippe Derakshani
*Attorney, Agent, or Firm*—Speckman & Pauley

[57] ABSTRACT

A closure for a rigid or deformable container. The contents of the container are protected by a seal. The closure has a bottom part and a cap fixed thereon by a hinge. The lower part is closed by a cover face, through which only a pouring spout extends. A tear-off element is positioned on an underside of the cap in such a way that it extends through the pouring spout as far as the seal located below it. The tear-off element is in active contact with the seal, for example, it is bonded or glued to it. At the time of a first opening, the tear-off element pulls the seal upwards, which is simultaneously broken by a cutting element below the pouring spout. Such closures are structurally simple in their manufacture as well as in operation and can be attached to various types of containers.

10 Claims, 4 Drawing Sheets

SINGLE OR MULTI-PIECE CLOSURE FOR RIGID OR DEFORMABLE CONTAINERS

BACKGROUND OF THE INVENTION

1. Field of the Invention

This invention relates to a single or multi-piece closure for a rigid or deformable container, in which contents have been sealed.

2. Description of Prior Art

Containers of several types with closures are known in the packaging industry, in which the contents are sealed. These may be bottles or canisters with a neck sealed by a foil, tubes with sealed tops or bonded bags in which the contents are kept under seal. Prior to metering out the contents of such containers by way of the closure, the seal must be broken. In some cases it is first required to remove the closure, then to break the foil and to replace the closure. In others, the cap of the closure first has to be opened and the foil located underneath has to be pierced through the outlet.

More recent embodiments recite closures with piercing elements positioned on the closure. For example, U.S. Pat. No. 4,722,449 discloses a closure with a piercing element, where the closure is maintained in an upper security position prior to a first opening of the foil and can only be pushed into a lower use position after a security band has been removed, the seal being destroyed simultaneously. Furthermore, a plastic closure described in U.S. Pat. No. 4,869,399, has a separately actuable piercing element next to the pouring opening. While the structurally simple closures are user-friendly, the user-friendly new closures are relatively complicated in a structural sense and correspondingly expensive.

SUMMARY OF THE INVENTION

It is therefore one object of this invention to provide a structurally simple, user-friendly closure having a wide field of application while maintaining a basic structural design.

This object is achieved by a closure having at least one tear-off element in active connection with a seal on the closure wherein the tear-off seal is used to tear the seal in a direction of opening when the closure is opened for a first time. One embodiment of the closure of this invention is particularly suitable for bottles, canisters, tubes and the like, while another embodiment is particularly suitable for bags or bag-like containers.

Although only closures made of plastic are described and shown in the following description and the drawings, this invention is not limited to embodiments made of this material. In general, it is possible to manufacture closures according to this invention with metal as well as plastic or combinations of both. The designing engineer also can essentially freely select the material of the seal. For example, the seal may be a metal or plastic foil or membrane, or may be made from a laminate of these two materials. A seal made of impregnated or coated papers is not uncommon. Furthermore, the seal may either be fastened directly on the container or may be inserted, prior to assembly, into the closure and connected with it. In a special case, even the container wall itself is part of the seal. The seal is preferably bonded or glued to the closure or the container. In certain cases, however, a simple mechanical clamping of the foil between the closure and the container may suffice. The variants mentioned above are only exceptionally treated in the description of the exemplary embodiments below.

One embodiment of a closure, according to this invention, for a container with a sealed container neck is schematically illustrated in detail in the attached drawings, along with further embodiments and will be described in the ensuing description.

DETAILED DESCRIPTION OF PREFERRED EMBODIMENTS

Figure 1:
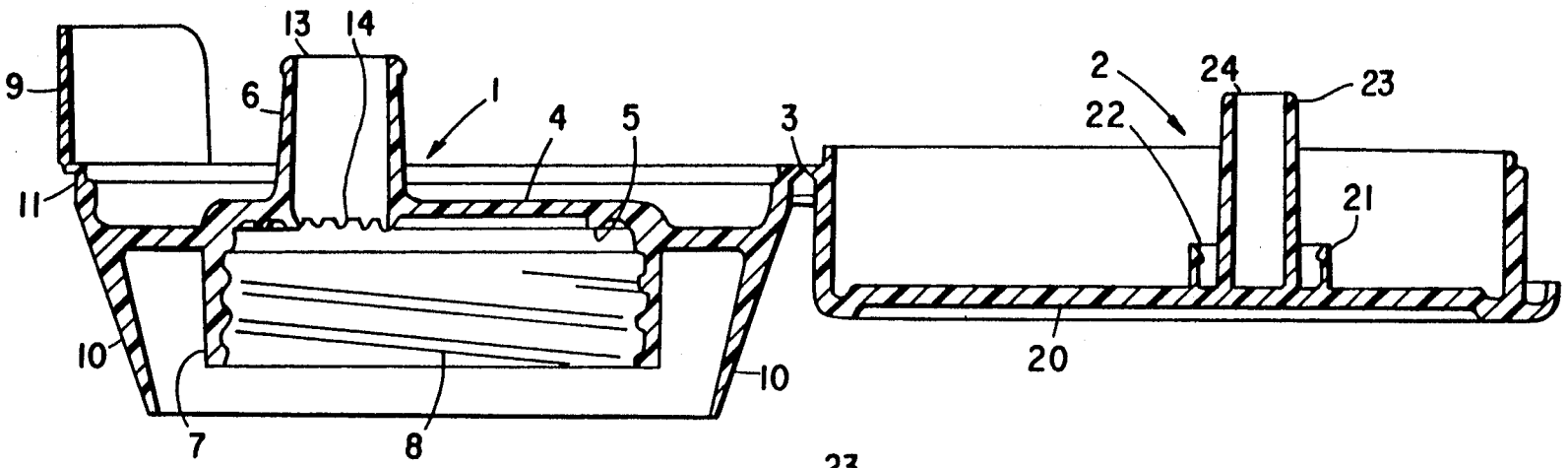
FIG. 1 is a longitudinal sectional view through a hinged snap closure in a completely open manufactured state.
Figure 2:
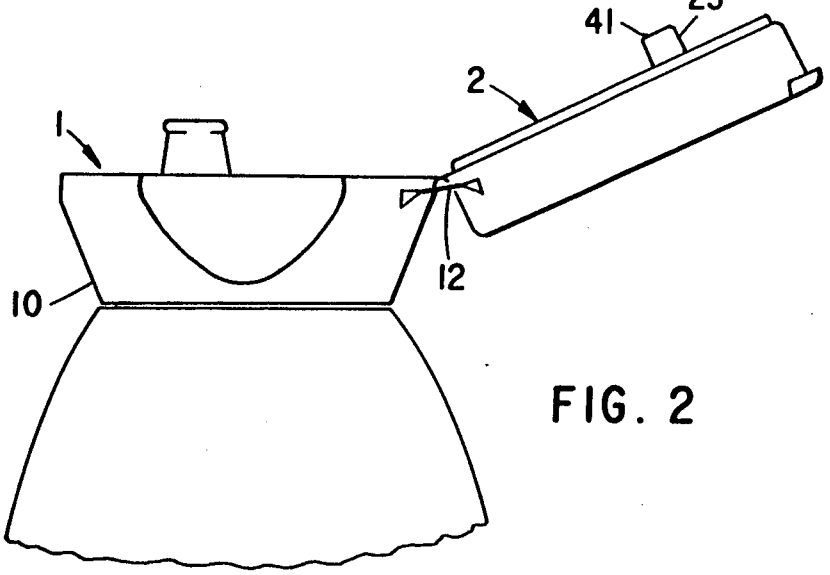
FIG. 2 is a side view of the closure of FIG. 1, after first opening.
Figure 3:
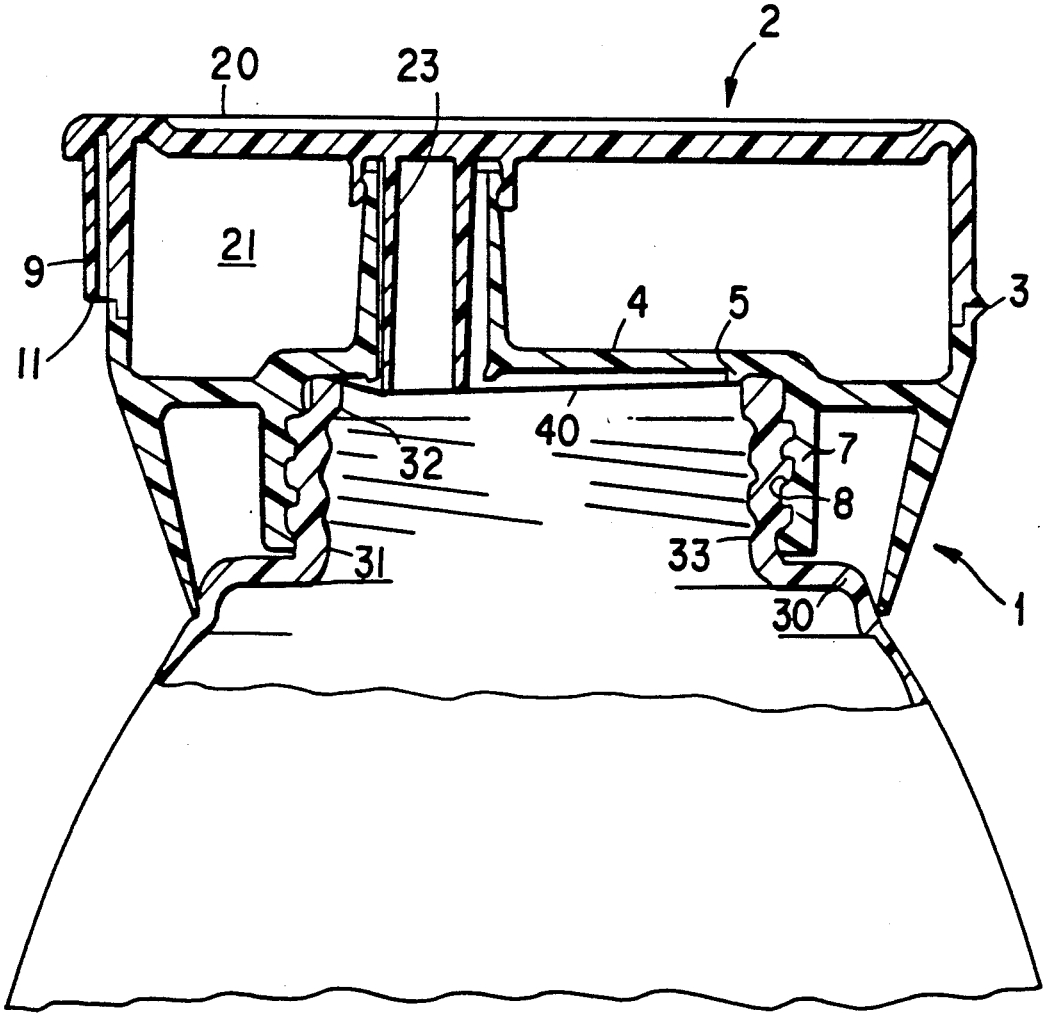
FIG. 3 is the same longitudinal sectional view as shown in FIG. 1, in an assembled state prior to a first opening.

The embodiment shown in FIGS. 1 to 3 illustrates a plastic closure which is particularly suitable for placement on bottles or canisters. The one-piece, extruded closure has a bottom part 1 connected with a cap 2 via a thin hinge 3. The bottom part 1 has a cover face 4, downwardly offset with respect to an upper rim of a former, through which extends a pouring spout 6. An annular wall 7 vertically extends from an underside of the cover face 4. The annular wall 7 has an inner thread 8 for joining the closure to the container. Furthermore, the underside of the cover face 4 has a circumferential bonding bead 5 extending concentrically inside the annular wall 7 and offset with respect to the annular wall 7, towards the interior, by approximately the thickness of the wall of the container. The cover face 4, outwardly extending over the entire annular wall 7, is bounded by a skirt-like outer wall 10. On the side of which facing away from the thin hinge 3, a security band 9 is positioned by means of bridges 11 which are used as predetermined breaking spaces. The security band 9 gives the consumer a visual indication that the product is intact.

The closure is designed as a hinged snap closure. The snap function is performed by spring elements 12; in the embodiment shown, the spring elements 12 are elastic bands. The cap 2 is covered by a covering face 20. An annular wall 21, directed towards the spout 6, is positioned on the inside of the covering face 20 and covers the pouring spout in the closed position. Sealing beads 22 and 13 are positioned on the annular wall 21 as is the pouring spout 6 for sealing.

A tear-off element 23 is vertically extruded from the covering face 20 inside the area enclosed by the annular wall 21. In the embodiment shown the tear-off element 23 is designed as a hollow pin. However, if the tear-off element 23 is of a smaller size, it may also be solid. The design engineer also basically can freely design the cross-sectional shape of the tear-off element 23. The essential requirement is that a sufficiently large frontal connection surface 24 be provided on the tear-off element 23. The frontal connection surface 24 is used as a bonding or gluing spot for the active connection with the foil or membrane located underneath it, in the closed position.

The closure shown in FIG. 3 is mounted on a container 30 prior to a first use. In this embodiment, the container 30 has a container neck 31 with an outer thread 33, which is matingly connected with the inner thread 8 of the annular wall 7. The front face 32 of the container neck 31 is located beneath the cover face 4 in an area between the annular wall 7 and the circumferential bonding bead 5. In the embodiment shown in FIG. 3, the seal 40 is a metal or plastic-metal-laminate foil which is inserted in the closed closure and screwed on the filled container 30. Then the closed container 30 is passed through a high frequency magnetic field. The seal 40 is heated there and bonds with the front face 32 of the container 30, the circumferential bonding bead 5, and with the frontal connection face 24 of the tear-off element 23. Prior to initial opening, the user first tears off the security band 9 by breaking the bridges 11, then opens the cap 2 of the closure and in this way moves the tear-off element 23, to which the seal 40 is attached, upward and thus breaks the seal. To make this easier, a cutting element 14 is provided as clearly shown in FIG. 1, and in the present case is a toothed ring disposed low on the pouring spout and directed towards the seal. FIG. 2 shows the closure after the first opening. The security band is no longer intact. Only the remainder of the foil 41 adheres to the tear-off element to show the consumer that the contents were sealed and that the seal has been broken.

Figure 4:
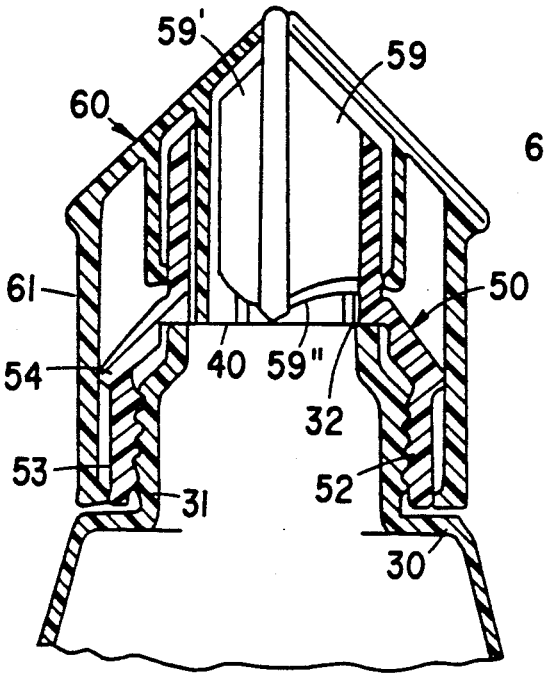
FIG. 4 is a longitudinal sectional view of a two-piece closure with a central sealing pin in a closed position, prior to a first opening.
Figure 5:
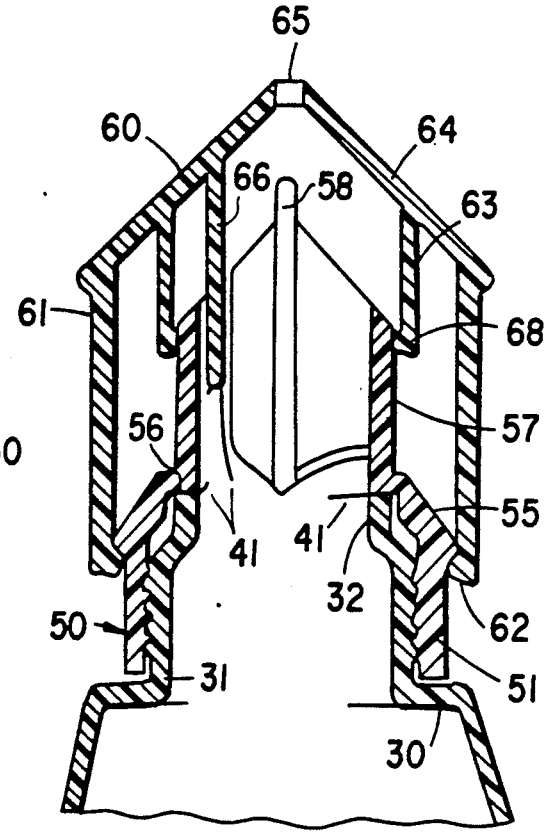
FIG. 5 is a longitudinal sectional view of the closure shown in FIG. 4 in an opened position after a first opening.
Figure 6:
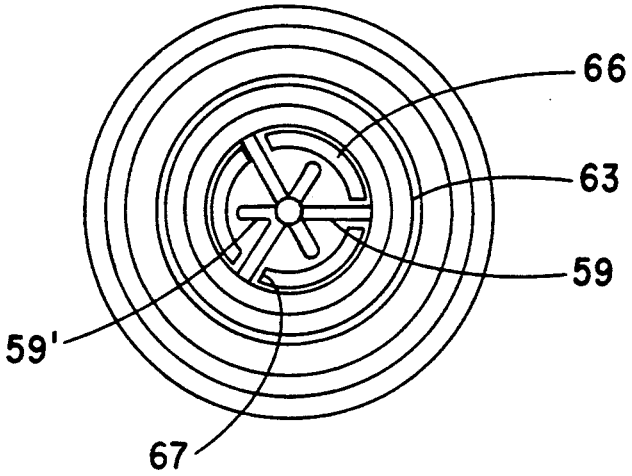
FIG. 6 is a bottom view of the closure as shown in FIG. 4, in an unassembled state.

Another embodiment of the identical principle of this invention is shown in FIGS. 4 to 6, in the form of a completely different closure. This type of closure is mainly applied to containers having pasty contents. Again, the container 30 has a container neck 31 with a flat front face 32. In this embodiment, a bottom part 50 is screwed on the outer thread 33 of the container neck 31. The bottom part 50 has an annular wall 51 with an inner thread 52 surrounding the neck 31 of the container. The inner thread 52 of the bottom part 50 exactly mates with the outer thread 33 of the container neck 31. The outside of the annular wall 51 is in the form of a sliding wall seal 53 and has a sealing bead 54 at its upper end. By means of a conical constriction 55, the bottom part 50 tapers to the size of the inside diameter of the container neck 31. In the assembled state of the closure, an interior, flat, annular shoulder 56 exactly fits on top of the flat frontal face 32 of container neck 31. A pipe-like guidance and sealing wall 57 extends vertically above the annular flat shoulder 56. The outside of the guidance and sealing wall 57 is also in the form of a sliding wall seal. Three cutting ribs 59 placed at regular intervals and directed radially inward extend from the inside of the guidance wall 57. Their lower edges are in the form of cutting edges 59''. A sealing pin 58 is positioned centrally between the three cutting ribs 59. One displacement rib 59' each is positioned between two adjacent cutting ribs 59 and projects radially outward from sealing pin 58. The displacement ribs 59' do not extend as far as the guidance and sealing wall 57, but are shortened with respect to the cutting ribs 59, in the radial direction. The sealing pin 58 extends upwardly in an axial direction above the several ribs 59 and 59', and ends in a tip.

A top part 60 is positioned on the bottom part 50 and is slidingly movable on bottom part 50 in the axial direction. Visible from the exterior is the lower, cylindrical jacket wall 61 of the top part 60 and the cone-shaped cover face 64 following it, which terminates in a pouring opening 65. The tip of the sealing pin 58 sealingly fits within the pouring opening 65. A sealing bead 62 is positioned at the lower edge on the inside of the cylindrical jacket wall 61. When assembling the closure, the lower sealing bead 62 must be snapped over the previously described sealing bead 54 on the bottom part 50.

A cylindrical sealing wall 63 is extruded, slightly offset towards the inside, concentric with respect to the jacket wall 61 on the underside of the cone-shaped cover surface 64. The cylindrical sealing wall 63 has an annular sealing bead 68 at the bottom end which adjoins the pipe-like guidance and sealing wall 57 of the bottom part 50. Further offset towards the interior and again concentric with respect to the cylindrical jacket wall 61, the tear-off element 66, in the shape of a pipe segment, is also extruded from the cone-shaped cover face 64. This axially extending tear-off element 66 is longer than the cylindrical sealing wall 63 and located further outward.

In a closed position of the closure, the tear-off element 66 extends as far as the level of the upper edge 32 of the container neck 31. The tear-off element 66, in the shape of a pipe segment, has three guide slits 67, through which the cutting ribs 59 of the bottom part extend radially inward. Therefore, the bottom part 50 and the top part 60 are assembled so that they cannot be rotated with respect to each other, but moved in a translational sense with respect to each other.

During assembly, first the top part 60 is snapped onto the bottom part 50, as already described. Then the seal 40, for example in the form of an aluminum foil, is placed into the bottom part 50 of the assembled closure and bonded to the flat, annular shoulder 56. Then the closure is rotated on the filled container 30. The aluminum seal 40 is heated in the high frequency induction field and thus bonds to the plastic container 30 and the lower face of the tear-off element 66. The top part 60 is pushed upwards when the closure is operated for the first time. In this case, the seal 40 tears in the area between the shoulder 56 and the upwardly moving tear-off element 66. Simultaneously, the cutting ribs 59 cut the foil 40 still adhering to the tear-off element 66, and the displacement ribs 59' push the remainder of the foil 40 outward. The sealing pin 5 is moved out of the pouring opening 65, so that the pasty contents can flow from the container 30, around the sealing pin 58 and out of the pouring opening 65.

Figure 7:
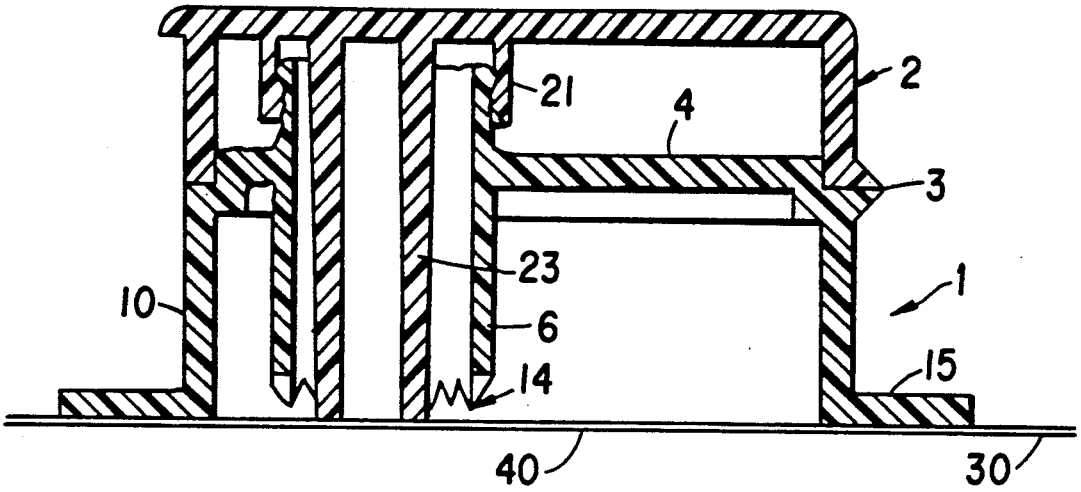
FIG. 7 is a vertical sectional view of a closure bonded to a bag, where a wall of the bag forms a seal.
Figure 8:
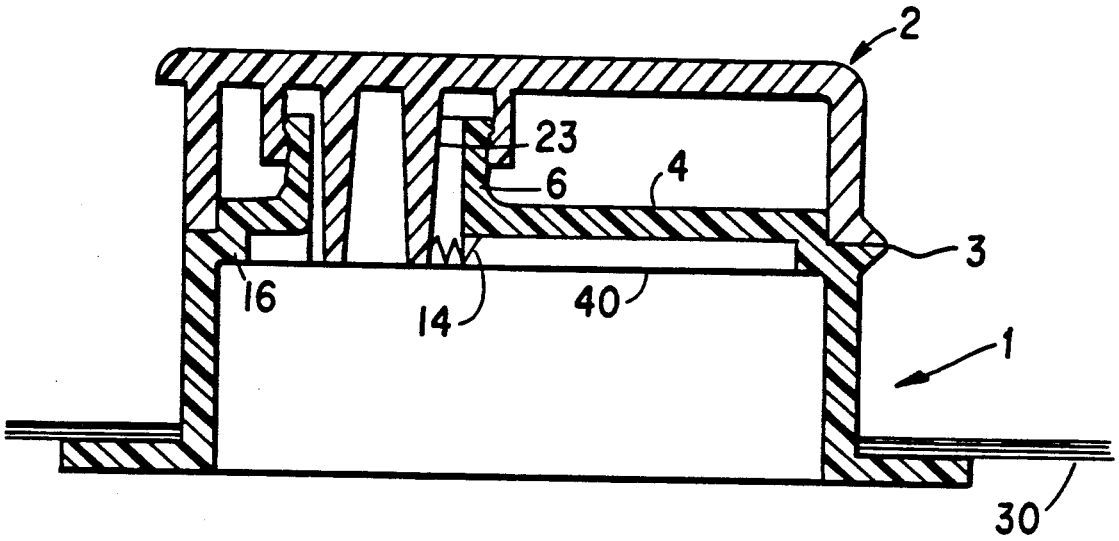
FIG. 8 is a vertical sectional view of an embodiment where the closure extends through the wall of the bag and where an additional seal is provided.

The two variants of the embodiment in accordance with FIGS. 7 and 8 are similar in structure to the embodiment in accordance with FIGS. 1 to 3. Therefore, the same reference numerals as in the first embodiment have been used for corresponding parts. In the two embodiments shown in FIGS. 7 and 8, the container 30 is a bag sealed by bonding. It may be made from polyethylene foil, for example. Again, the closure of this invention has a bottom part 1 and a cap 2 connected by a thin hinge 3. Again, the bottom part 1 has an annular outer wall 10, closed by a cover face 4. A pouring spout 6 also extends through the cover face 4. An outwardly directed flange 15 is positioned at the lower edge of the outer wall 10. The bottom part of the flange 15 is somewhat lower than the bottom part of the pouring spout 6, which has a cutting element 14 in the shape of a toothed ring at its end. The tear-off element 23 is also extruded from the cap 2, inside of the annular wall 21 which surrounds the pouring spout. The tear-off element 23 is long enough so that in the closed position of the closure, it extends approximately at least as far as the level of the bottom part of the flange 15. The closed closure can now be glued or bonded directly on the bag-like container 30. During bonding, the flange 15 as well as the tear-off element 23 are connected with the foil of the container 30. In this case, the part of the container located below the closure simultaneously forms the seal.

During the first opening of the closure, the part of the container 30 which forms the seal 40 is pulled upwards by the tear-off element 23, where the teeth of the toothed ring 14 perforate and cut open the foil.

The embodiment shown in FIG. 8 differs from the embodiment shown in FIG. 7 in that the bag-like container 30 has a stamped-out opening through which the bottom part of the closure extends. The foil of the container 30 is bonded to the top of the flange 15. Thus the foil of the container 30 no longer forms the seal. It is therefore necessary to provide, on the bottom of the cover face 4, an annular shoulder 16 to which a seal 40 can be bonded. In this case, an appropriate foil is placed in the bottom part 1 after the closure has been finished, and is bonded to the shoulder 16 and the tear-off element 23 prior to joining the closure to the container 30. In contrast to the embodiment of FIGS. 1 to 6, the closures shown in FIGS. 7 and 8 are positioned on an empty container 30 and not on a filled container. The bags, still open on one side, but with the closures already bonded thereon, are filled and then the bags are bonded shut, so that the contents are sealed in the containers 30. It is of course also possible to seal the closures, shown in FIGS. 7 and 8, by security bands.

What is claimed is:

1. A closure in combination with a container, in which contents of the container have been sealed, the closure comprising: a seal (40), at least one tear-off element (23, 66) in active connection with said seal (40), said at least one tear-off element (23, 66) provided on the closure, and tearing the seal in a direction of opening when the closure is opened a first time;

said container having a container neck (31), said seal (40) being one of a foil, a membrane of metal or a metal laminate positioned on the container neck (31), and wherein said seal and said tear-off elements being connected by a bonded or a glued spot; and said closure further comprising a bottom part (1) forming a pouring spout (6), a cap (2) pivotally connected with said bottom part (1), said tear-off element (23) on said cap (2) extending through said pouring spout (6) when the closure is in a closed position, and said bottom part (1) having a cutting element (14) directed towards said seal (40).

2. A closure according to claim 1, wherein said cap (2) has an annular wall (21) surrounding said tear-off element (23), and said annular wall (21) form-fittingly seals said pouring spout (6) at said bottom part (1).

3. A closure according to claim 1, wherein said tear-off element (23) has a compatible shape which sealingly fits into said pouring spout (6) in said bottom part (1).

4. A closure according to claim 1, wherein a length of said tear-off element (23) is greater than a length of said pouring spout (6), and in said closed position of the closure, said tear-off element (23) rests on said seal (40) in such a way that said seal (40) adjoins the tear-off element (23) under an initial tension.

5. A closure according to claim 1, further comprising an extension of said pouring spout (6) on said bottom part (1) and said cutting element (14) forming a ring of teeth extending toward said seal (40) in said extension.

6. A closure according to claim 1, further comprising a security band (9) which must be removed or broken prior to a first opening.

7. A closure for a deformable container in a shape of a bag, the closure comprising: a seal (40), at least one tear-off element (23, 66) in active connection with said seal (40), said at least one tear-off element (23, 66) provided on the closure, and tears the seal in a direction of opening when the closure is opened a first time, a bottom part (1) forming a pouring spout (6), a cap (2) pivotally connected with said bottom part (1), said tear-off element (23) on said cap (2) extending through said pouring spout (6) when the closure is in a closed position, and said bottom part (1) having a cutting element (14) directed towards said seal (40); and said bottom adapted to extend through a wall, said bottom part having a flange (15) for fastening to an inner wall surface of said bag, and said bottom part (1) closed with one of a foil or a membrane forming a seal (40) upon which said tear-off element (23) acts.

8. A closure for a deformable container in a shape of a bag, the closure comprising: a seal (40), at least one tear-off element (23, 66) in active connection with said seal (40), said at least one, tear-off element (23, 66) provided on the closure and tearing the seal in a direction of opening when the closure is opened a first time, a bottom part (1) forming a pouring spout (6), a cap (2) pivotally connected with said bottom part (1), said tear-off element (23) on said cap (2) extending through said pouring spout (6) when the closure is in a closed position, and said bottom part (1) having a cutting element (14) directed towards said seal (40); and said cap (2) adapted to sealingly connect with an outside surface of a wall of said bag with a flange (15), said wall of said bag underneath said bottom part (1) forming a seal (40) to be broken.

9. A closure in combination with a container, in which contents of the container have been sealed, the closure comprising: a seal (40), at least one tear-off element (23, 66) in active connection with said seal (40), said at least one tear-off element (23, 66) provided on the closure and tearing the seal in a direction of opening when the closure is opened a first time;

said container having a container neck 31, said seal (40) being one of a foil, a membrane of metal or a metal laminate positioned on the container neck (31), and wherein said seal and said tear-off elements (23, 66) being connected by a bonded or a glued spot;

the closure having a bottom part (50) with a sealing pin (58) provided thereon, a top part (60) movably disposed above said bottom part (50), said top part (60) having a pouring opening (65) within which said sealingly pin (58) sealingly fits, and a tear-off element (66) in a form of a pipe segment positioned concentrically around said sealing pin (58) and in active connection with said seal (40); and radially outward directed cutting ribs (59) positioned on said sealingly pin (58) for breaking said seal (40).

10. A closure according to claim 9, wherein between each two adjacent said cutting ribs (59) a corresponding displacement rib (59') is positioned which displaces remaining portions of said foil (41) of said seal (40) from a flow-through area of the closure.

* * * * *